United States Patent [19]

Moeneclaey et al.

[11] Patent Number: 4,875,505

[45] Date of Patent: Oct. 24, 1989

[54] THREAD CLAMP

[75] Inventors: Denis Moeneclaey, Westrozebeke-Staden; Lucien Coopman, Zonnebeke; Johnny Victoor, Langemark, all of Belgium

[73] Assignee: Picanol N.V., Belgium

[21] Appl. No.: 170,011

[22] Filed: Mar. 18, 1988

[30] Foreign Application Priority Data

Apr. 2, 1987 [BE] Belgium ..... 8700341

[51] Int. Cl.[4] ..... D03D 47/27

[52] U.S. Cl. ..... 139/448; 139/2

[58] Field of Search ..... 139/2, 429, 447, 448, 139/449

[56] References Cited

U.S. PATENT DOCUMENTS 3,719,211 3/1973 Porter ..... 139/448
3,880,200 4/1975 Fabre .
3,963,058 6/1976 Dewhirst ..... 139/2
4,708,174 11/1987 Vandeweghe et al. ..... 139/448

FOREIGN PATENT DOCUMENTS 0137377 4/1985 European Pat. Off. ..... 139/448
1444834 3/1966 France ..... 139/448
1347537 2/1974 United Kingdom .

*Primary Examiner*—Henry S. Jaudon
*Attorney, Agent, or Firm*—Bacon & Thomas

[57] ABSTRACT

A thread clamp, with the characteristic that it consists essentially of: a first jaw (3) with two spring arms (4, 5) which bend elastically away from and towards each other, perpendicularly to the plane in which the thread clamp opens and closes; a second jaw (6) which operates in conjunction with the first jaw; and an elastic device which serves to press the two jaws (3, 6) together.

12 Claims, 4 Drawing Sheets

Fig. 8
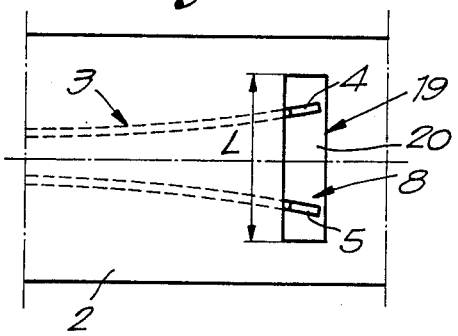
Fig. 9
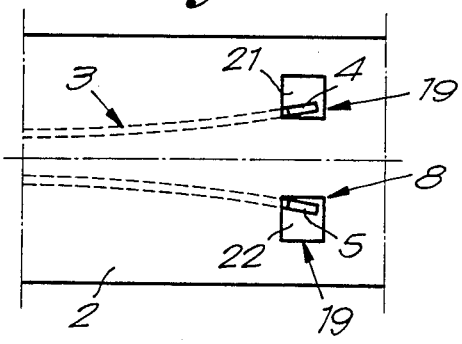
Fig. 10
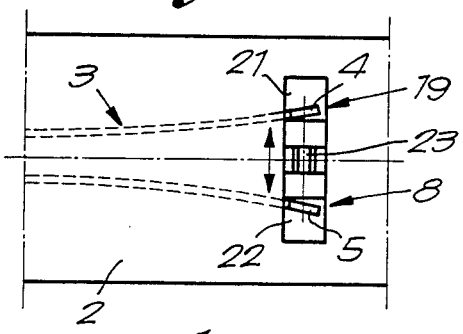
Fig. 11
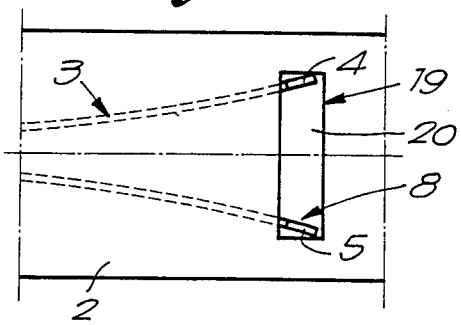
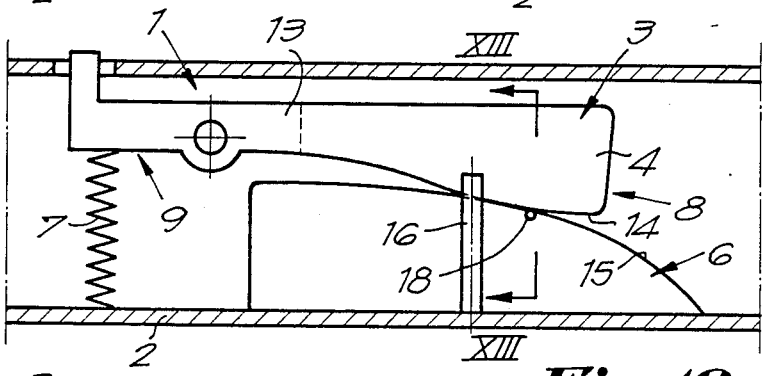
Fig. 12
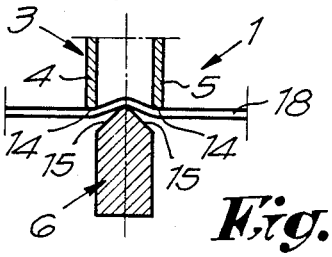
Fig. 13

Fig. 14
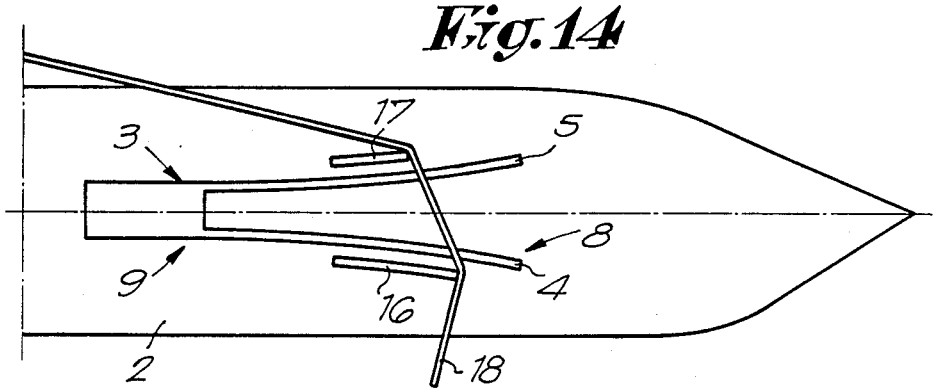
Fig. 15
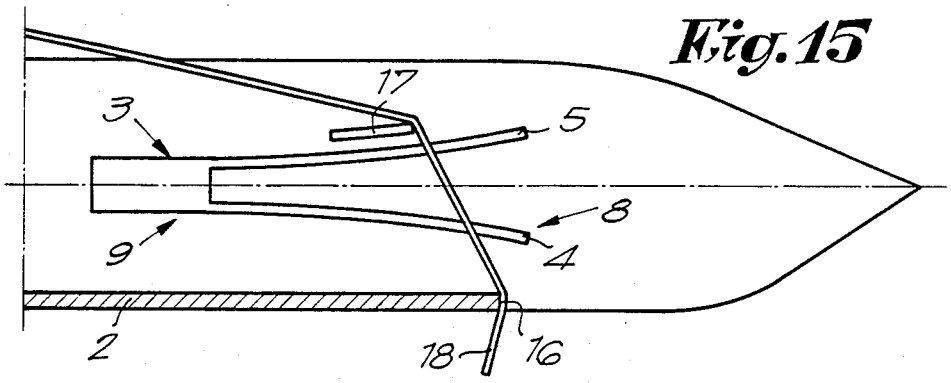
Fig. 16
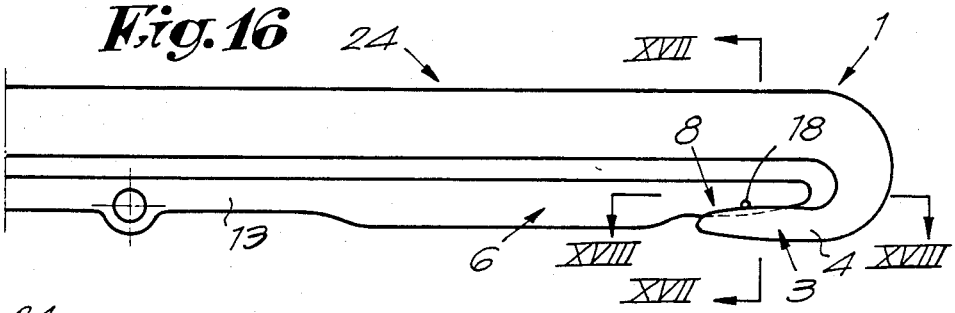
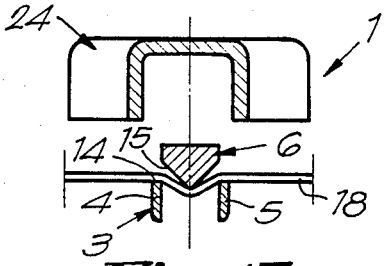
Fig. 17
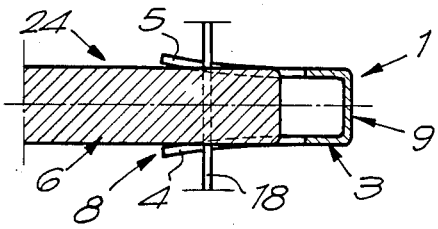
Fig. 18

THREAD CLAMP

FIELD OF THE INVENTION

This invention concerns a thread clamp, and more particularly a thread clamp of the type which consists of two opposing parts which are pressed together and between which a thread or the like can be held. In particular, the invention concerns a thread clamp for use on weaving machines, for example for a feed gripper or a receiving gripper on a thread presentation mechanism.

BACKGROUND OF THE INVENTION

The first requirement of a thread clamp on a weaving machine is that it must be suitable for a wide range of threads. Textiles are always composed of several types of threads which have to be gripped in turn by the same thread clamp, for example the thread clamp of a feed gripper or receiving gripper or of a thread presentation mechanism.

A thread clamp should preferably be broad enough that it can handle a wide range of threads and yet not have to be reset or readjusted when changing from one type of textile to another.

Another important requirement is that the thread clamp should always operate with as much precision as possible, even when the mechanical parts become worn.

An important improvement which enables these requirements to be met is described in Belgian patent No. 902.141, corresponding to U.S. Pat. No. 4,708,174, made by the present applicant, concerning a thread clamp for weaving machine grippers which is characterised by a fixed bit which operates in conjunction with an elastically deformable wire spring, thus partly compensating for the effects of wear. Practical experience has since shown that this type of thread clamp is less suitable for certain types of thread, since thread fibres tend to come loose and to get wound round the wire spring, where they remain.

SUMMARY OF THE INVENTION

The present invention concerns a thread clamp which does not have this disadvantage and which also gives better clamping of the thread. To this end, the thread clamp according to the invention consists essentially of: a first jaw with two spring arms which bend elastically away from and towards each other, perpendicularly to the plane in which the thread clamp opens and closes; a second jaw which operates in conjunction with the first jaw; and an elastic device which serves to press the two jaws together.

In a preferred embodiment, the spring arms of the first jaw consist of two lamellae, while the second jaw is wedge-shaped and presses said lamellae apart.

BRIEF DESCRIPTION OF THE DRAWINGS

For the purpose of describing the characteristics of the invention, the following preferred embodiments are described with reference to the accompanying drawings, by way of example only and without being limitative in any way, where:

FIG. 8 shows a view in the direction of the arrow F8 in FIG. 1;

FIGS. 9 to 11 show other variants, in the same view as in FIG. 8;

FIG. 12 shows an embodiment of the thread clamp, in which the first jaw is in the form of a lever;

FIG. 13 is a cross-section along the line XIII—XIII in FIG. 12;

FIGS. 14 and 15 show two configurations for thread stops;

FIG. 16 shows the clamp according to the invention being used in a receiving gripper;

FIG. 17 is a cross-section along line XVII—XVII in FIG. 16;

FIG. 18 is a cross-section along line XVIII—XVIII in FIG. 16;

DETAILED DESCRIPTION OF THE PREFERRED EMBODIMENTS

Figure 1:
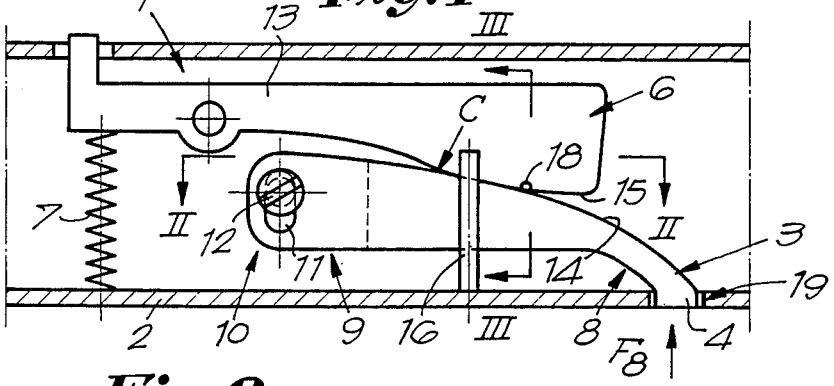
FIG. 1 shows a thread clamp according to the invention, forming part of a feed gripper.
Figure 2:
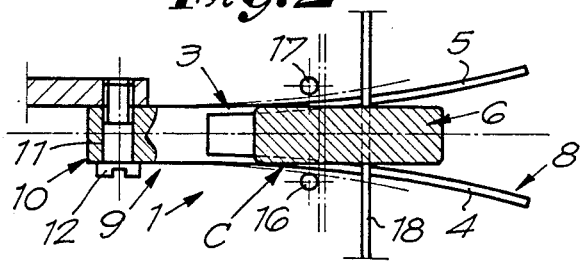
FIG. 2 is a cross-section along the line II—II in FIG. 1.
Figure 3:
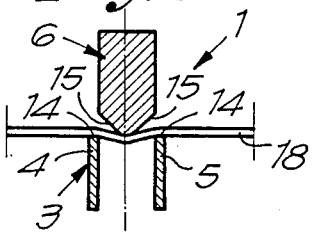
FIG. 3 is a cross-section along the line III—III in FIG. 1.

As shown in FIGS. 1 to 3, the thread clamp 1 according to the invention—here mounted by way of example on a feed gripper 2—consists essentially of: a first jaw 3 made up of two spring arms 4 and 5 which bend elastically away from or towards each other, perpendicularly to the plane in which the opening and closing movements of the clamp are carried out; a second jaw 6 which operates in conjunction with the two spring arms 4 and 5; and an elastic device 7, e.g. a spring, which presses the jaws 3 and 6 together.

The spring arms 4 and 5 consist essentially of two lamellae mounted a short distance apart. The first jaw 3 may be in the shape of a fork, as shown in FIG. 2. The spring arms 4 and 5 may diverge towards the open end 8. At the base 9 the first jaw 3 is provided with an adjustment device 10 consisting of a slit 11 and a screw 12, by means of which the first jaw 3 at the open end 9 can be moved away from or towards the second jaw 6.

The second jaw 6, as shown in FIGS. 1 to 3, consists of the end of a lever 13, which at its other end is activated by an elastic device 7. Further, the second jaw 6 consists essentially of a wedge-shaped element, in particular as shown in FIG. 1. The first and second jaws 3 and 6 and their cooperating edges 14 and 15 are shaped so that they come into contact only at a certain point when there is no thread between them, i.e. so that the second jaw 6 does not make contact with the first jaw 3 over its whole length. This is achieved by the divergence of the spring arms 4 and 5, also by the curved shape of the two jaws, in particular as seen in FIG. 1.

The thread clamp 1 may also have stops 16 and 17 alongside one or both of the jaws 3 and 6 in order to prevent a thread held in the clamp 1, e.g. a weft thread 18, entering too far between the spring arms. Alternatively, the stops 16 and 17 may be positioned so that they place a limit on the amount by which the spring arms 4 and 5 can open, as indicated by the broken line in FIG. 2.

The operation of the device shown in FIGS. 1 to 3 is essentially as follows: when a thread 18 is not present, the cooperating edges 14 and 15 of the first and second jaws 3 and 6 cooperate, so that the wedge-shaped second jaw 6 penetrates by a certain amount between the spring arms 4 and 5 and presses them elastically away from each other. When the feed gripper is presented to a taut weft thread 18, the thread 18 enters between the first and second jaws 3 and 6 and is clamped between them, as shown in FIGS. 2 and 3. It can clearly be seen that due to the spring action of the arms 4 and 5 the first and second jaws 3 and 6 always fit perfectly together, so that the thread 18 is always firmly clamped.

It should be noted that the point C at which the first and second jaws 3 and 6 make contact with each other when a thread 18 is not present should preferably be behind the thread stop 16 or the thread stops 16 and 17, i.e. between the relevant stop 16 and/or 17 and the base 9 of the first jaw 3. This gives the advantage that any thread fibres which come loose from the thread do not remain stuck in the clamp when the thread is removed from the clamp.

Figure 4:
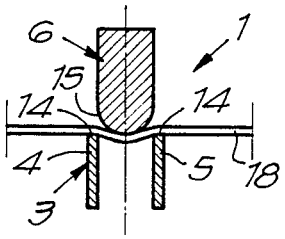
FIGS. 4 to 6 show variants, in the same view as in FIG. 3.
Figure 5:
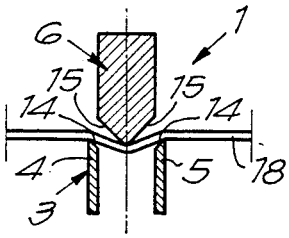
Figure 6:
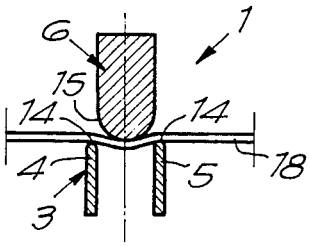

FIGS. 4 to 6 show some variants with differences in the shape of the cooperating edges 14 and 15 of the first and second jaws 3 and 6.

Figure 7:
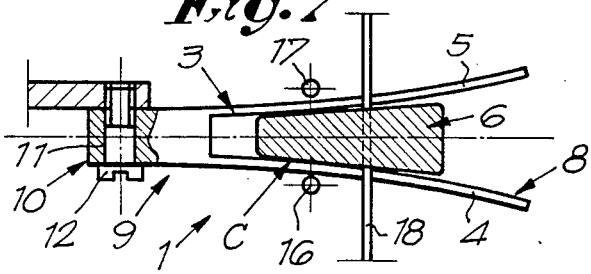
FIG. 7 represents another variant of the embodiment shown in FIG. 1, in the same view as in FIG. 2.

FIG. 7 shows a variant in which the sides of the second jaw 6 diverge towards the top of the second jaw 6. It is also possible for the shape of the cooperating edge 15 of the second jaw 6 to vary along the length of the jaw. For example, the angle or the radius of the cooperating edge 15 may increase towards the top of the jaw 6.

In the embodiment shown in FIG. 1 the spring arms 4 and 5 each have a free end 8. As shown in particular in FIG. 8, there may a device 19 at the ends of the spring arms 3 and 4 in order to limit their movement. FIGS. 9 to 11 show variants of such an arrangement.

In FIGS. 1 and 8, the device 19 for limiting the movement of the spring arms 4 and 5 consists essentially of a recess or slot 20 or suchlike, into which the ends 8 of the spring arms 4 and 5 reach. When the jaws 3 and 6 come together the ends 8 of the spring arms 4 and 5 can only move apart to a maximum of the full length L of the slot 20.

In FIG. 9 the abovementioned device 19 consists of two recesses 21 and 22 or suchlike, into which the ends 8 of the spring arms 4 and 5 reach. By such an arrangement, the spring arms 4 and 5 can be pretensioned so that a certain amount of resistance first has to be overcome before they can be opened further.

There may also be an adjusting device 23 between the spring arms 4 and 5 in order to set the amount by which the spring arms are forced apart, thus enabling the degree of pretension to be adjusted.

As shown in FIG. 11, the amount of pretension on the spring arms 4 and 5 can be such that the spring arms are held in their maximum open position.

FIGS. 12 and 13 show a variant of the thread clamp 1 according to the invention, again used in a feed gripper 2. In this case it is the first jaw 3 which forms part of the lever 13 instead of the second jaw 6. The spring arms 4 and 5 here consist of lamellae which extend freely from the end of the lever 13. The second jaw 6, or at least the wedge-shaped part of it, is solidly attached to the feed gripper 2. The operation is similar to that of the other variants described above. The use of the thread stops 16 and 17 has already been described with reference to the variant shown in FIGS. 1 to 3. FIGS. 14 and 15 show yet another two variants of the thread stops, with the particular characteristic that the stops 16 and 17 are shifted with respect to the long axis of the thread clamp 1. This gives better clamping of the thread 18 in the direction in which the thread is stressed by the clamp. In FIG. 15, the stop 16 is formed by the body of the feed gripper 2. FIGS. 16 to 18 show how a thread clamp 1 according to the invention is used in a receiving gripper 24. The construction is essentially similar to that of the embodiments already described.

Figure 19:
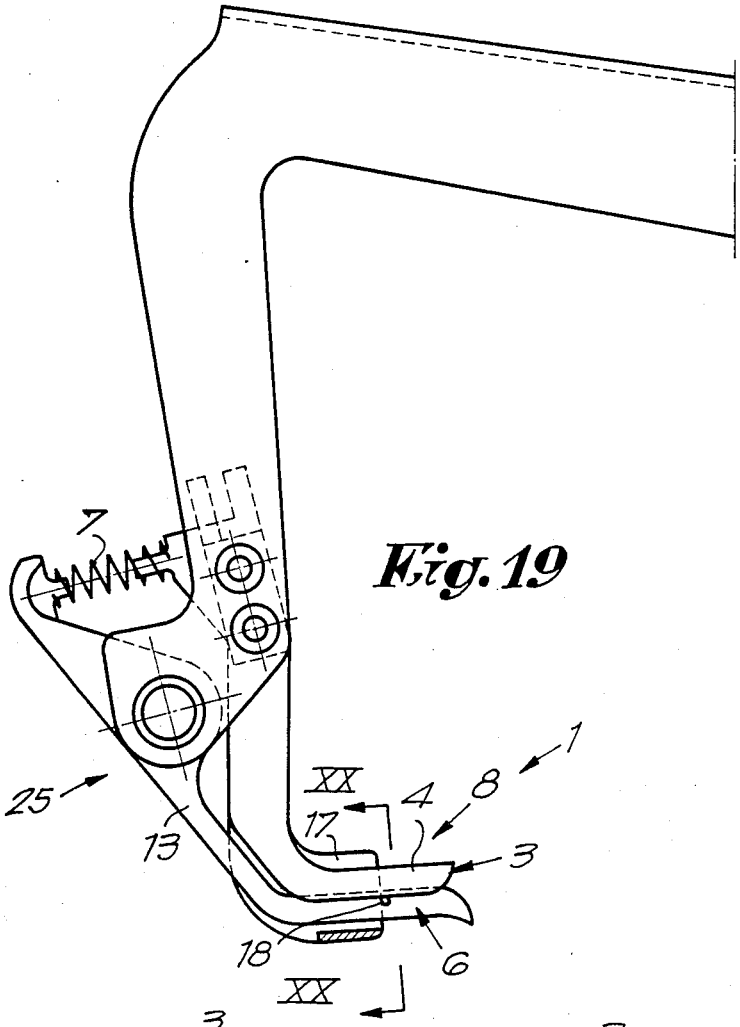
FIG. 19 shows a thread clamp according to the invention being used in a thread presentation mechanism.
Figure 20:
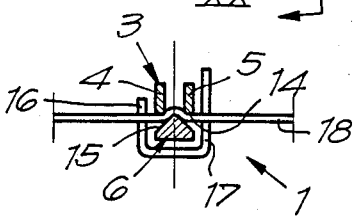
FIG. 20 is a cross-section along line XX—XX in FIG. 19.

FIGS. 19 and 20 show yet another thread presentation arm 25 using a thread clamp 1 according to the invention. Such a thread presentation arm 25 can for instance form part of the thread presentation mechanism described in Dutch patent application No. 8600857 by the present applicant.

Figure 21:
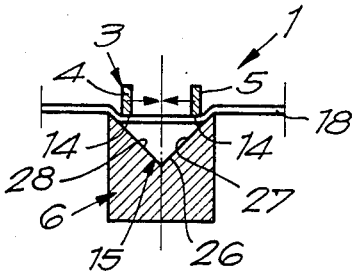
FIG. 21 is a cross-section of yet another variant of the thread clamp according to the invention.

As shown in FIG. 21, the second jaw 6 may also consist of a groove 26, e.g. a V shape, whose sides 27 and 28 cooperate with the edges 14 and 15 of the spring arms 4 and 5 of the first jaw 3. This embodiment of the thread clamp 1 can of course be used in a feed gripper 2, receiving gripper 24 or thread presentation arm 25 as described above.

The present invention is in no way limited to the variants described by way of example and shown in the accompanying drawings; on the contrary, such a thread clamp may be made in various forms and dimensions while still remaining within the scope of the invention.

We claim:

1. A thread clamp comprising:

a pair of clamping jaws movable toward and away from each other between closed and open positions, respectively:

biasing means for elastically biasing said jaws towards a closed position;

a first jaw of said pair of jaws comprising two spring arms each having a fixed first end and a free second end, said fixed ends being disposed at a common location with said free ends extending away from said location adjacent each other, and with said free ends being elastically bendable in directions transverse to the direction of opening and closing of said jaws;

said free ends of said first jaw diverging away from each other at least when said jaws are closed;

said second jaw engaging each of said free ends when the jaws are closed.

2. A thread clamp as claimed in claim 1, wherein the free ends of the spring arms of the first jaw are provided with a device to limit their movement, said device comprising at least one recess into which the free ends reach.

3. A thread clamp as claimed in claim 1, further comprising two stops for preventing thread movement in one direction, wherein said two stops are located on opposite sides of the jaws.

4. A thread clamp as claimed in claim 3, wherein the respective points at which said stops prevent thread movement lie on a line that is oblique to the longitudinal axis of the clamp.

5. A thread clamp as claimed in claim 1, wherein the thread clamp forms part of a feed gripper.

6. A thread clamp as claimed in claim 1, wherein the thread clamp forms part of a receiving gripper.

7. A thread clamp as claimed in claim 1, wherein the thread clamp forms part of a thread presentation mechanism.

8. A thread clamp, comprising:

a first jaw having two spring arms each having first and second ends, said first ends being fixed with respect to each other, and said second ends diverging from each other when the thread clamp is open; wherein said spring arms bend elastically away from and towards each other perpendicularly to the plane in which the thread clamp opens and closes;

a second jaw that operates in conjunction with the first jaw; and an elastic device that serves to press the first and second jaws together.

9. A thread clamp as claimed in claim 8, wherein said second ends are free ends.

10. A thread clamp as claimed in claim 9, further comprising a device to limit the movement of the free ends, said device comprising at least one recess into which the free ends reach.

11. A thread clamp as claimed in claim 8, wherein said spring arms comprise lamaellae that are fixed to each other at said first ends.

12. A thread clamp, comprising:

a first jaw having two spring arms that each have first and second ends, said first ends being fixed with respect to each other, and said second ends diverging from each other when said thread clamp is closed, wherein said spring arms bend elastically away from and towards each other perpendicularly to the plane in which the thread clamp opens and closes;

a second jaw that operates in conjunction with the first jaw;

an elastic device that serves to press the first and second jaws together; and two stops for preventing a thread from moving in at least one direction, wherein said two stops are located on opposite sides of the jaws.

* * * * *